US007334793B2

(12) United States Patent
Hurwitz

(10) Patent No.: US 7,334,793 B2
(45) Date of Patent: Feb. 26, 2008

(54) GAME AND METHOD OF PLAYING THE GAME

(75) Inventor: Marc Hurwitz, Milwaukee, WI (US)

(73) Assignee: Playful Planet Games, LLC, Milwaukee, WI (US)

( * ) Notice: Subject to any disclaimer, the term of this patent is extended or adjusted under 35 U.S.C. 154(b) by 0 days.

(21) Appl. No.: 11/363,767

(22) Filed: Feb. 28, 2006

(65) Prior Publication Data

US 2006/0202421 A1 Sep. 14, 2006

Related U.S. Application Data

(60) Provisional application No. 60/659,651, filed on Mar. 8, 2005.

(51) Int. Cl.
*A63F 3/00* (2006.01)

(52) U.S. Cl. ..... 273/273; 273/299; 273/429

(58) Field of Classification Search ..... 273/272, 273/299, 429, 430, 431, 432
See application file for complete search history.

(56) References Cited

U.S. PATENT DOCUMENTS 3,503,612 A * 3/1970 Singer ..... 273/272
4,306,724 A * 12/1981 Brzezinski et al. ..... 273/243
4,341,389 A * 7/1982 Dumont ..... 273/265
4,923,199 A * 5/1990 Hahn ..... 273/299
4,934,711 A * 6/1990 Runstein ..... 273/272
5,586,765 A * 12/1996 Lackey ..... 273/299
5,921,864 A * 7/1999 Walker et al. ..... 463/9
6,098,983 A * 8/2000 Kennedy ..... 273/272
6,378,868 B1 * 4/2002 La Bossiere ..... 273/272
6,769,692 B1 * 8/2004 Cavalluzzo ..... 273/272

OTHER PUBLICATIONS

HASBRO, The Basic Rules of Scrabble®, available at least as early as Mar. 8, 2005.
Parker Brothers, Rules of Boggle® Hidden Word Game, available at least as early as Mar. 8, 2005.

* cited by examiner

*Primary Examiner*—William M. Pierce
(74) *Attorney, Agent, or Firm*—Michael Best & Friedrich LLP

(57) ABSTRACT

A method of playing a game having multiple rounds between a plurality of players. The method includes initiating a first phase of the game, the first phase including selecting a plurality of words, scrambling the letters from each word of the plurality of words on a game board, passing the game board to a second player, and unscrambling the letters provided by the first player into words. The method also includes awarding a score for the second player for the first phase based upon the success of the second player in unscrambling the letters into words. A second phase of the game is initiated, the second phase including utilizing the letters from the first phase to create new words of varying length. The method further includes awarding a score for the second player for the second phase based upon the success of the player in creating new words.

13 Claims, 5 Drawing Sheets

| | | | | |
|---|---|---|---|---|
| 4 | keen | perceptive, eager | mush | thick porridge |
| 5 | shape | outer form | dense | tightly packed |
| 6 | affirm | assert | mother | female parent |
| 4 | west | direction of sunset | gown | women's dress |
| 5 | empty | containing nothing | brash | hasty |
| 6 | magnet | attracts metal | punish | penalty for offense |
| 4 | edit | revise | rain | falling water |
| 5 | union | combination | seize | grab |
| 6 | amount | sum | lotion | softening liquid |
| 4 | tube | hollow cylinder | task | duties |
| 5 | jewel | precious stone | teach | impart knowledge |
| 6 | resent | fell indignant | peanut | edible nut |

38

FIG. 4

Scoring Sheet

Player or Pairs of Players

| Rounds / Phases | NAME | NAME | NAME | NAME |
|---|---|---|---|---|
| Round 1 | | | | |
| **Decipher** | | | | |
| Base | | | | |
| Bonus | | | | |
| **Formulate** | | | | |
| Base | | | | |
| Bonus | | | | |
| Subtotal – Round 1 | | | | |
| Round 2 | | | | |
| Total from previous round | | | | |
| **Decipher** | | | | |
| Base | | | | |
| Bonus | | | | |
| **Formulate** | | | | |
| Base | | | | |
| Bonus | | | | |
| Subtotal – Rounds 1 & 2 | | | | |
| Round 3 | | | | |
| Total from previous round | | | | |
| Total from previous round | | | | |
| **Decipher** | | | | |
| Base | | | | |
| Bonus | | | | |
| **Formulate** | | | | |
| Base | | | | |
| Bonus | | | | |
| Subtotal – Rounds 1, 2 & 3 | | | | |
| Round 4 | | | | |
| Total from previous round | | | | |
| Total from previous round | | | | |
| **Decipher** | | | | |
| Base | | | | |
| Bonus | | | | |
| **Formulate** | | | | |
| Base | | | | |
| Bonus | | | | |
| Subtotal – Rounds 1, 2, 3 & 4 | | | | |

Scratch Pad Space

*FIG. 5*

GAME AND METHOD OF PLAYING THE GAME

RELATED APPLICATIONS

This application claims priority to previously-filed U.S. Provisional patent application Ser. No. 60/659,651, filed Mar. 8, 2005, the entire contents of which is incorporated by reference herein.

FIELD OF THE INVENTION

The invention relates to a game, and more specifically to a word game directed to improving the vocabulary and language skills of the people who play the game.

BACKGROUND OF THE INVENTION

Various board games or parlor games exist whose purpose is to both entertain and educate those who play them. Some of these types of games require the players to create words or phrases from a given group of letters. For example, in the word game SCRABBLE, players choose several letters from a pool of letters and create words from their portion of the pool, collecting points based upon the length of the word created and the particular placement of the letters on the corresponding SCRABBLE game board. Other word games, such as the word jumble found in many daily newspapers, require the players to rearrange a given group of letters into a word of predetermined length.

SUMMARY OF THE INVENTION

It is desirable to provide a game that entertains and encourages people to improve vocabulary skills as well as conceptual and problem solving skills.

The present invention is directed to a game that allows players to engage in both word unscrambling and word formation in the same game. The players can control the difficulty of each game, based upon the words chosen. The game is designed to be played in either a public setting, with an audience viewing the people playing the game, or in a parlor or home setting. In some embodiments, the game involves using three-dimensional game pieces having letters on the pieces to help the players in solving scrambled words and then creating new words. Multiple game boards are used to play the game, with each individual player utilizing their own game board. The game provides for social interaction between the players, while stimulating excitement about words. In this regard, the game can be used as a teaching tool. When the game is played in a public setting, the game allows for passive audience participation as the audience can see the scrambled words and try to solve the words. In such a setting, the information on the individual player's game boards may be broadcast or otherwise rewritten for audience review.

In one aspect, the invention includes a method of playing a game. The method includes initiating a first phase of the game, the first phase including a first player selecting a plurality of words, scrambling the letters from each word of the set of words on a game board, passing the game board to a second player, and the second player unscrambling the letters provided by the first player into words. The method also includes awarding a score for the second player for the first phase based upon the success of the second player in unscrambling the letters into words. A second phase of the game is initiated, the second phase including utilizing the letters from the first phase to create new words of varying length. The method further includes awarding a score for the second player for the second phase based upon the success of the second player in creating new words.

In one embodiment, the method further includes providing assistance to the second player in the first phase to assist the second player in unscrambling the letters. In another embodiment, unscrambling the letters from the first player occurs within a given time limit. In another embodiment, the method further includes initiating a subsequent round of the game.

The invention also includes a game. The game includes a game board, a set of game pieces, at least a portion of which include letters printed thereon, a word sheet, a scoring sheet, and a timing mechanism. The word sheet includes a plurality of words thereon.

Other features and advantages of the invention will become apparent to those skilled in the art upon review of the following detailed description and drawings.

BRIEF DESCRIPTION OF THE DRAWINGS

FIG. 4 is an exemplary word sheet to be used when playing the game according to one embodiment of the invention.

FIG. 5 is an exemplary scoring sheet for use in keeping score when playing the game according to one embodiment of the invention.

DETAILED DESCRIPTION

Figure 1:
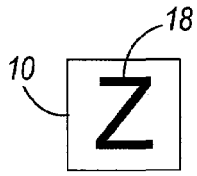
FIG. 1 is a front view of a game piece for use in a game according to one embodiment of the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including", "having", and "comprising" and variations thereof herein is meant to encompass the items listed thereafter and equivalents thereof as well as additional items.

Figure 2:
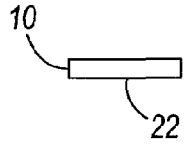
FIG. 2 is a side view of the game piece illustrated in FIG. 1.
Figure 3:
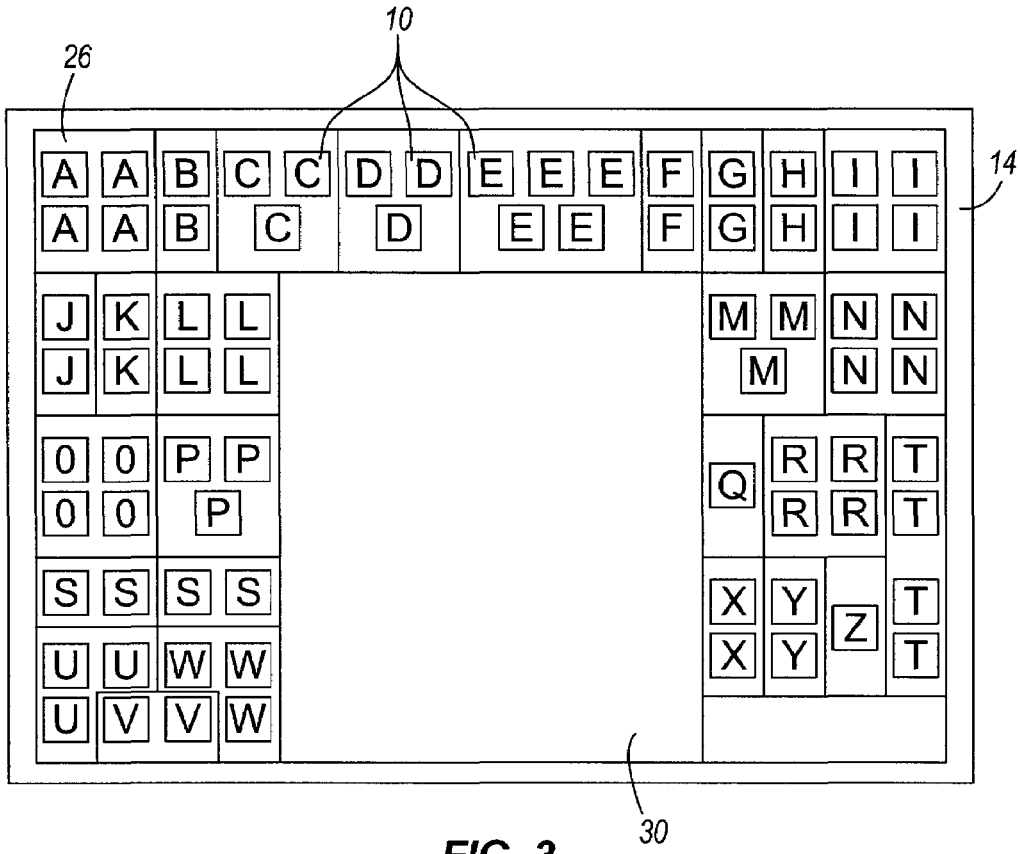
FIG. 3 is a top view of a game board for use in playing the game according to one embodiment of the invention.

To play the game, the players manipulate game pieces 10, shown in FIGS. 1 and 2, on a game board 14, shown in FIG. 3. The game pieces 10 can be formed of plastic or wood and each will have a letter 18 on one side, and a magnetic backing 22 on the opposite side. The game piece 10 of the illustrated embodiment is approximately ⅝"×⅝"×⅛" in size, though other sized game pieces 10 can be used and still fall within the scope of the present invention. Each game board 14 includes a set of game pieces 10, such as the game piece shown in FIG. 3. Each set of game pieces 10 includes seventy-five letter tiles and five blank tiles. When packaged for retail sale, each game includes up to four game boards 14 and four sets of game pieces 10.

At least a portion of each game board 14 is magnetically attractable such that the game board 14 is able to receive magnets on at least a portion of the game board 14. In the illustrated embodiment, the entire game board 14 is magnetically attractable. As shown in FIG. 3, the game board 14 is approximately ten inches by fourteen inches in dimension, and includes a game piece storing portion 26 and a working space 30, each of which are magnetically attractable. The working space 30 is designed to provide space to the players to decipher and formulate words according to the rules of the game, as will be described in more detail below. The game board 14 of the illustrated embodiment is rectangular in configuration and designed to rest on a table top (or other support surface), though it is understood that other game board configurations are possible and still fall within the scope of the present invention. For example, the game board could also include a lap cutout portion that is designed to fit around the torso of the player. It is understood that in other embodiments, the game board can take other configurations to better suit the needs of the players and still fall within the scope of the present invention.

Each game board 14 also comes with one or more sets of word sheets 38 that include words that can be used to play the game, as will be discussed in more detail below. An exemplary sheet 38 is illustrated in FIG. 4. As shown, the word sheet 38 is substantially rectangular in shape, forming a word strip, although it is understood that other sheet configurations are possible and still fall within the scope of the present invention.

In the illustrated embodiment, each game includes twelve word sheets 38, each sheet 38 including a total of twenty-four words per side, for a total of 576 unique words. Each sheet 38 includes sets of random words of varying lengths (e.g. 4-letter, 5-letter, and 6-letter), and includes brief common definitions or synonyms for each word. This is the basic set of sheets 38 included with the game. The various word groupings on the sheets 38 allow the players to control the level of difficulty of the game. It is understood that in other embodiments, the words listed on the sheets 38 may not be grouped into sets, but rather the players can pick and choose the desired grouping of words for use in the game from anywhere in the list.

In other embodiments, the words on the sheets 38 can be arranged by word length, or could be arranged or grouped by level of difficulty such that some sheets 38 could be geared toward younger players, while other sheets 38 could be geared toward more sophisticated players. In other embodiments, words for use in the game of the present invention could be organized in other ways, including but not limited to organization by theme or subject matter (e.g., sports, movies, science, etc.), or by degree of difficulty (e.g., longer or more esoteric words for advanced players). These additional sets of sheets may be sold separately from the game.

Figure 6:
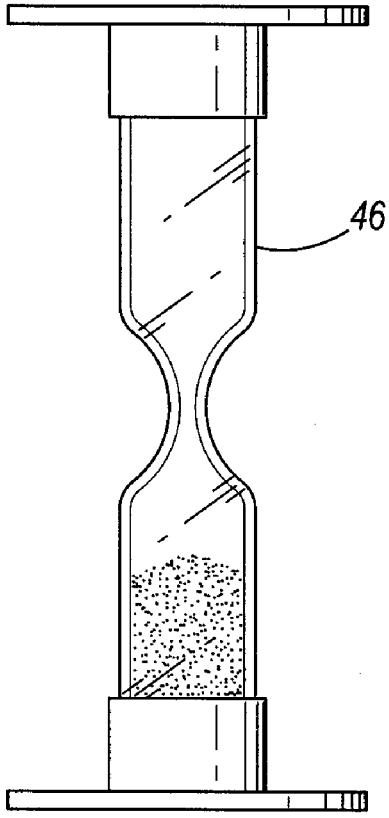
FIG. 6 is a front view of an exemplary timing mechanism for use with the game according to one embodiment of the invention.
Figure 7:
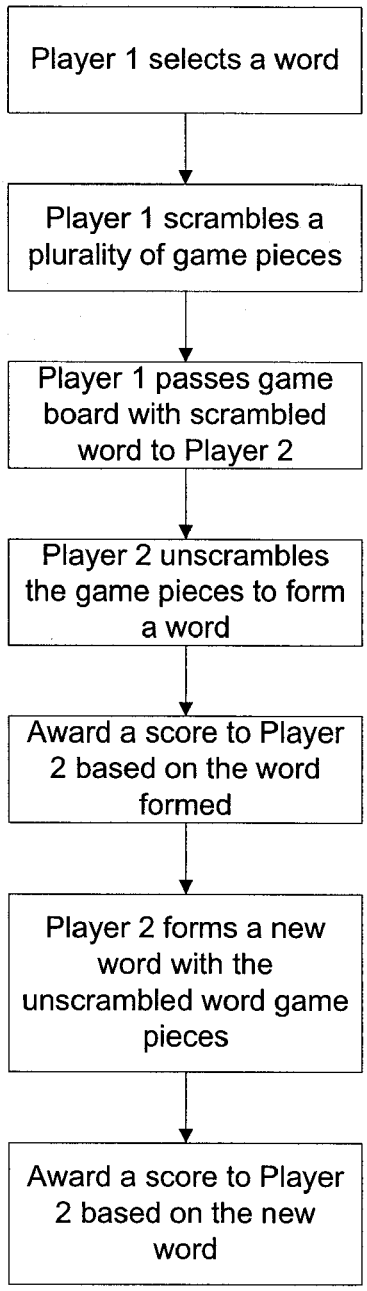
FIG. 7 is a flow chart of the method of playing the game according to one embodiment of the invention.

The game also includes at least one scoring sheet, such as the scoring sheet 42 illustrated in FIG. 5. The scoring sheet 42 can be used to keep score to determine the winner of the game. It is understood that in other embodiments and other variations of the game, other scoring sheets can be used and still fail within the scope of the present invention. The scoring sheet 42 included with the game is used as a master sheet, from which additional copies can be made for use during the games. The game also includes timing mechanism 46 to help keep the game moving, and a set of game instructions. The timing mechanism 46 may be a sand timer, such as shown in FIG. 6, or may be any type of timer suitable for providing an indication of a predetermined length of time, such as an egg timer or electronic timer. In some embodiments, the game may not include a timing mechanism such that the players are responsible for keeping time themselves by using a personal watch, clock, or other suitable method.

When the game is played in a public setting, a mechanism can be provided to allow the audience to watch the players play the game, and to even passively participate in the game as the audience follows the action of the players. In some embodiments, the mechanism could include a projector, a camera, a TV screen, electronic boards, scoreboard, or other mechanisms may be used to broadcast the actions of the players for audience viewing and would still fall within the scope of the present invention. In still other embodiments, the mechanism could be a pedestal or other device that makes the game board 14 viewable to the audience. Using the configuration discussed above, the game could be played in a shopping mall, at a school, in a television studio, or in any other place where an audience can watch, observe, and play along with the players.

To begin the game, each player (up to four) gets a board 14 with magnetic game pieces 10 placed in designated positions in the storage portion 26 of the board 14, and a word sheet 38 with random words. The game is a series of successive rounds and each round includes two phases. Each player uses their own game board 14.

In phase I, each player starts with a first set of three words on a word sheet 38. In the illustrated embodiment, this would be a four-letter word, a five-letter word, and a six-letter word, though other grouping options are possible. The players can control the level of difficulty for each round based upon the length of words selected from the sheets 38. The players then take the corresponding letters (i.e., corresponding game pieces 10) for each word from the board 14 and form a scramble of the letters for each word in the working space 30. This is part of the fun and strategy, figuring out the best, most obscure way to scramble the words.

The players then pass their boards 14 to another player (this can be based upon various patterns-e.g., to the right, to the left, across). Each player then proceeds to solve each scrambled word within a set time limit (e.g., 3 minutes, as provided by the included timing mechanism 46), using all the letters for each scrambled word by manipulating the game pieces 10 within the working space 30. At the end of that time limit clues are given at a player's request to help solve any of the word(s) remaining. The clue can be the synonym or concise definition on the word sheet, though other clues are possible. For example, these clues may also include a category that the word falls in (e.g., flower, sports, movies, etc.), or may include some number of the letters from that word provided in successive order. If the first clue does not help solve the word, then a second clue may be provided. It is possible and acceptable that a solved word differs from the word on the sheet as long as it is a real word (e.g., the word pear can also be reap), and so long as all the scrambled letters are used to create the word.

Scoring for the first phase involves base points and a possible bonus. For each word solved without assistance (i.e., no hints given), two points per letter in each word solved is awarded. For example, a four-letter word scores eight points, a five-letter word scores ten points, and so on. If all three words are solved without assistance, the total base points are forty (based upon the use of a four-letter word, a five-letter word, and a six-letter word), and additional ten bonus points are awarded. There is no bonus if one or more words require a hint to solve. This score is recorded on the score sheet 42 for each player. The scoring for each player can be done by a single person, such as a moderator, or each individual player can keep their own score.

Once all of the words are known, phase II begins. Each player keeps the game board 14 on which that player has unscrambled the letters in phase I. Each player, using all of the letters available from phase I, begins forming different individual words. Each letter can only be used once. Each word formed must be at least two letters in length, although this could be mutually set at a higher level (e.g., 3 or 4 letters). The objective is to use all of the letters while simultaneously trying to make the longest words possible. The three minute time limit also applies to this phase.

Scoring for this phase also involves a base set of points and a possible bonus. For each word formulate, five points per letter in the word are awarded. Thus, a four-letter word is worth twenty points, a two-letter word is worth ten points, and so on. In addition, if all the letters are used, there is a bonus of ten points awarded. There are also bonus points for forming words of six or more letters. Every letter over five in a single word is worth an additional ten points. As such, the scoring for phase II would work as follows:

3 letter word—15 points
4 letter word—20 points
5 letter word—25 points
6 letter word—30 points plus 10 bonus points (one letter over five)
7 letter word—35 points plus 20 bonus points (two letters over five)
8 letter word—40 points plus 30 bonus points (three letters over five)

It should be understood that while one specific scoring method is discussed above, other scoring methods for both phase I and phase II are possible and still fall within the scope of the present invention. For example, the points that are awarded for each word created may be equal to the square of the number of letters (e.g., creating a four-letter word would give the player sixteen points), or the points per letter could increase with the size of the words (e.g., a four-letter word could be worth four points per letter, a five-letter word worth five points per letter, a six-letter word worth six points per letter, etc.).

At the end of the round, the scores are recorded. A running total is maintained across rounds. At the end of the round, each player returns the game pieces 10 to the storage area 26 on the board 14, and each player chooses another set of words to begin phase I again if another round is to be played. If played in a public setting, the boards showing the letters to the audience would be erased. The winner of the game can be the player with the highest point total after a set number of rounds (such as four rounds), or can be based upon reaching set point level as determined by the players at the outset (such as a total of 500 or 1000). The players should designate the game's ending point at the beginning of the game. The scoring methodology described above rewards positive results with both base points and bonus point, and does not penalize the players for unsuccessful results. As such, the game is not only educational, but entertaining and could be used not only in a social setting, but also in an educational setting by teachers, tutors, or the like.

The game could be played according to a number of variations of the rules discussed above. For example, the as described above could be called the slower, more contemplative and thoughtful version. It is based upon each player choosing multiple words to be scrambled and solving by another player, and is played at a slower more contemplative and thoughtful pace where players have several minutes to solve the scrambled words as well as several minutes to form words with the total available letters.

A faster variation could be based upon all players solving the same multiple words scrambled. One player would need to act as a moderator providing the scrambled word to all of the players at the same time. The number of words played in phase I would be set by the players. For example, a total of approximately 15-20 letters used (e.g., two 5-letter words and one 6-letter word). This version could be played at a much faster pace with no hints. The first player to solve each word would be the winner for that word and awarded a specified number of points. The faster variation could also include only a single round having phases I and II, as opposed to the multiple round version described above.

For phase II, the players would take all of the letters and the first player to use the available letters to form words would be the winner of phase II, similar to the manner described above. Constraints could be placed on the length of words necessary. For example, at least one five letter and one four letter word could be required.

Another variation could include team play. In this version, players would team together to work against others, following the rules of either the slower variation or faster variation described above.

Yet another variation could be in how the game is supported, for example, by providing definitions for the words at the outset of phase I. Each definition would be shown randomly to be used as hints for unscrambling the words, or the definitions could be linked to specific words. While making the game easier to play, provision of the definitions would also have the advantage of reinforcing definitions with the players. This could be especially useful when played with younger kids.

The game is described above using manually maneuverable game boards and game pieces to physically unscramble the listed words and create new words from the same letters. In other embodiments, players could play the game described above electronically on a computer or on hand held devices that are linked together. In these embodiments, the word lists and scoring rules would be found on software that would be installed on the computer and/or hand held device and the software would control the game. The game board would then be illustrated on the screen of the computer monitor or hand held device. When played on the computer, it would be possible to play with other players around the world using the internet by downloading the appropriate software onto the individual computers.

Various features of the invention can be found in the following claims.

What is claimed is:

1. A method of playing a game, the game played by a plurality of players, the method comprising:

initiating a first phase of a first round of the game, the first phase including a first player selecting a word, the first player scrambling a plurality of game pieces on a game board, each game piece including a letter of the selected word, passing the game board to a second player, and the second player unscrambling the plurality of game pieces provided by the first player into a word;

awarding a score for the second player for the first phase based upon the success of the second player in unscrambling the game pieces into a word;

initiating a second phase of the game, the second phase including utilizing the game pieces from the first phase to create a new word; and awarding a score for the second player for the second phase based upon the success of the second player in creating the new word.

2. The method of claim 1, further comprising initiating a subsequent round of the game.

3. The method of claim 1, wherein scrambling the game pieces from the word includes removing the game pieces from a storage area of the game board and moving the game pieces to a working space of the game board.

4. The method of claim 1, further comprising providing assistance to the second player in the first phase to unscramble the game pieces.

5. The method of claim 1, wherein unscrambling the game pieces occurs within a given time limit.

6. The method of claim 1, wherein awarding a score for the second player for the first phase includes awarding a given number of points per letter on each game piece of the word unscrambled.

7. The method of claim 1, wherein awarding a score for the second player for the first phase includes awarding bonus points when predetermined conditions are met.

8. The method of claim 1, wherein awarding a score for the second player for the second phase includes awarding a given number of points per letter on each game piece of the word created.

9. The method of claim 8, wherein awarding the score for the second phase further includes awarding bonus points for a word created that exceeds a given length.

10. A method of playing a word game by a plurality of players, the word game utilizing game pieces, a word sheet, and a game board, the word game including successive rounds, the method comprising:

initiating a first phase of the game, the first phase comprising a first player selecting a set of words from the word sheet, the first player moving game pieces from a storage area of the game board to a working area of the game board, the game pieces having letters corresponding to the set of words selected, the first player scrambling the game pieces including the letters from each of the words in the working area of the game board, and passing the game board with the scrambled words thereon to a second player, the second player then unscrambling the words on the game board by manipulating the game pieces within the working area;

awarding a score to the second player for the first phase based upon the success of unscrambling the letters into words, the score varying based upon whether assistance was provided to unscramble the letters;

initiating a second phase of the game, the second phase comprising manipulating the letters of the words formed in the first phase into a plurality of new words of varying length;

awarding a score to the second player for the second phase based upon the success in creating new words, the score varying based upon the length of the new words created; and initiating a subsequent round of the game;

wherein selection of the set of words from the word sheet adjusts the level of difficulty of the game base upon the set of words chosen.

11. The method of claim 10, wherein scrambling the game pieces includes strategizing the best way to organize the letters for each of the plurality of players.

12. The method of claim 10, further comprising providing a hint to the second player in the first phase to unscramble the words.

13. The method of claim 10, wherein awarding a score for the second phase includes awarding bonus points when all of the available letters are used in creating the new words.

* * * * *